US006273401B1

(12) United States Patent
Payne

(10) Patent No.: US 6,273,401 B1
(45) Date of Patent: Aug. 14, 2001

(54) METHOD AND APPARATUS FOR TRUCK TARP LOADING

(76) Inventor: Fred V. Payne, 516 W. Main St., Fredonia, NY (US) 14063

( * ) Notice: Subject to any disclaimer, the term of this patent is extended or adjusted under 35 U.S.C. 154(b) by 0 days.

(21) Appl. No.: 09/386,199

(22) Filed: Aug. 31, 1999

Related U.S. Application Data

(60) Provisional application No. 60/098,476, filed on Aug. 31, 1998.

(51) Int. Cl.[7] ..... B66D 1/00

(52) U.S. Cl. ..... 254/266; 212/166; 254/286; 254/295

(58) Field of Search ..... 254/266, 324, 254/286, 294, 295, 338; 135/87, 90, 115; 296/98; 212/166

(56) References Cited

U.S. PATENT DOCUMENTS

| | | | | |
|---|---|---|---|---|
| 2,529,948 | * | 11/1950 | Jones | 254/324 |
| 3,397,009 | * | 8/1968 | Landenberger . | |
| 3,614,154 | * | 10/1971 | Evans | 296/100.16 |
| 4,236,859 | * | 12/1980 | Stearn et al. | 254/324 |
| 5,692,534 | * | 12/1997 | Brumfield | 135/90 |
| 5,743,515 | * | 4/1998 | Wodell | 254/324 |
| 5,743,700 | * | 4/1998 | Wood, Jr. et al. | 414/498 |
| 5,964,236 | * | 10/1999 | Berke | 135/87 |
| 6,003,929 | * | 12/1999 | Birdsell | 296/100.16 |

OTHER PUBLICATIONS

Load Protection: A Case Study in Ergonomics and Safety; W.S. Green et al. no date available.*

* cited by examiner

*Primary Examiner*—Katherine A. Matecki
(74) *Attorney, Agent, or Firm*—The Bilicki Law Firm, P.C.

(57) ABSTRACT

The apparatus for covering large object typically comprises one fundamental unit, although a plurality of fundamental units may be used. The fundamental unit comprises four vertical support members, a top rectangular support frame, arms, a plurality of hanger members fixedly secured to arms, a first plurality of straps operatively engaging the hanger members, a plurality of rollers fixedly attached to the arms and operatively engaging the vertical support members, and a lifting device.

The method of utilizing the invention comprises the following steps: lowering the arms of the apparatus to the ground, attaching the first set of truck straps to the quick release hangers of the first arm and the u-hooks of the second arm so that the straps stretch across the apparatus to connect the arms, unfolding a sheet of plastic and/or a tarp over the straps, raising the arms of the apparatus thereby raising the straps and the tarp or plastic above the height of the load of the truck trailer, positioning the truck trailer directly underneath the raised arms, and lowering the arms of the apparatus so that the tarp lays flat upon the load of the truck trailer.

20 Claims, 9 Drawing Sheets

METHOD AND APPARATUS FOR TRUCK TARP LOADING

This patent application claims priority to U.S. Provisional Patent Application, Ser. No. 60/098,476 filed on Aug. 31, 1998.

TECHNICAL FIELD

This invention generally relates to covering large containers. More specifically, this invention relates to the process of covering loaded trailer trucks with tarps or related coverings.

BACKGROUND ART

Due to the nature of truck design for carrying certain materials, (i.e. gravel, garbage, large odd shaped objects and the like) there is a need to cover these materials to prevent damage to the materials and to prevent their release onto the highway. These loads, that are placed upon the beds of trailers, require a protective covering. Typically, this protective covering takes the form of sheets of plastic material and/or a canvas material, such as a tarp that are secured to the load and the trailer bed so as to prevent exposure of the load to the elements. The tarp and plastic are secured to the trailer bed so as to prevent flapping or tearing of the plastic from the excessive wind forces that most trailer beds undergo during the course of transporting loads on highway systems.

The tarps and plastic are typically folded or rolled up to conserve space when the tarps and plastic are not in use. The tarps used are generally heavy and quite bulky, making it difficult to cover the load, especially if one person is working alone. Even when multiple people are covering the load it is still a hazardous activity. Generally, the method of tarping has been to place a person on top of the load and to lift the tarp up to the person. The person on top of the load must unfold the tarp and evenly cover the load all while perched on top of the load. This is very dangerous and many accidents have occurred because people have lost their footing and fallen off the load that they were trying to cover.

The trucking industry has responded with three partial solutions to the aforementioned problems. The first is to place fall supports in the places where tarping of the loads is to occur. Fall supports are expensive and should be individualized to each tarper. Further, fall supports do not adequately protect the tarper from being hurt. Although the fall support prevents the person from hitting the ground, when a person strapped to a fall support falls, he falls into free space with no method of controlling his direction or speed. Instances have occurred where a person, strapped to a fall support, has fallen off the load he was tarping and swung into free space. The person then swung back and slammed into the load of the truck that he was tarping and was seriously injured.

The second solution is a mechanized tarp loader. This device hooks to the grommets that are found in typical commercial tarps. The device then pulls the tarp from the ground over the load to the other side of the load. This device does not work for many different kinds of materials, such as sheets of plastic, since the hooks will rip the plastic or the plastic must possess grommets for the hooks to engage. In addition, if the load has sharp edges of any sort, dragging the tarp along the sharp edges will tear the tarp, thereby exposing the load to the elements.

The third solution is the attachment of a crane-like device to the truck to assist with lifting the covering over the load.

Two problems still exist with these devices. First, the covering material must be dragged across the load, resulting in damage to the load being covered or the covering itself depending on the nature of these materials. Second, the added expense and added weight to the truck load make these devices less desirable.

DISCLOSURE OF INVENTION

The apparatus of the instant invention is comprised of one fundamental unit. The fundamental unit comprises a plurality of vertical support members made of any sound and strong structural material, a top rectangular support frame, arms made of any sound and strong structural material, a plurality of quick release hangers fixedly secured to the first arm, a plurality of u-hooks fixedly secured to the second arm, a first set of a plurality of truck straps operatively engaging the u-hooks and the quick release hangers, a plurality of rollers fixedly attached to the arms of the apparatus and operatively engaging the vertical support members of the apparatus, a plurality of gear motors operatively engaging the spools and shafts, a plurality of lifter u-hooks, a second set of a plurality of truck straps operatively engaging the spool and the lifter u-hooks, and a plurality of spools driven by the gear motors.

The method of the instant invention comprises the following steps: lowering the arms of the apparatus to the ground, attaching the first set of truck straps to the quick release hangers of the first arm and the u-hooks of the second arm so that the straps stretch across the apparatus to connect the arms, unfolding a sheet of plastic and/or a tarp over the straps, raising the arms of the apparatus thereby raising the straps and the tarp or plastic above the height of the load of the truck trailer, positioning the truck trailer directly underneath the raised arms, and lowering the arms of the apparatus so that the tarp lays flat upon the load of the truck trailer.

In a preferred embodiment, each quick release hanger comprises two sides, each side comprising a horizontal member and a rounded L-shaped member integral with the horizontal member and fixedly secured with an attachment member and operatively arranged so as to permit movement about the axis of the attachment member with respect to an arm of the truck tarping apparatus, and a plurality of guiding members integral with the sides. Of course, one skilled in the art could envision a number of different hanger variations that would not depart from the spirit and scope of the disclosed invention.

In a preferred embodiment, each spool comprises a substantially cylindrical member with a keyed access hole for receiving a keyed shaft and a flat side, a strap attachment member wherein a truck strap is placed between the strap attachment member and the flat side of the cylindrical member, and a plurality of attachment members that fixedly secure the strap attachment member to the flat side of the cylindrical member without piercing the truck strap. As one skilled in the art would appreciate, a number of attachment means to secure the strap could be utilized.

Each roller assembly comprises an angle with a vertical support attachment member and a roller attachment member with an outside face wherein the vertical support attachment member and the roller attachment member form a ninety (90) degree angle with respect to each other and the vertical support attachment member is fixedly secured to an end of an arm of the truck tarp loading apparatus, a plurality of extenders fixedly secured to the roller attachment member on the outside face such that the extenders are diagonally opposite one another, and a plurality of rollers fixedly secured to the extenders. This preferred embodiment could be adapted to use a variety of roller type devices currently known to those skilled in the art.

It is an object of the present invention to provide a method and apparatus for covering a load on a trailer bed that allows personnel to remain on the ground.

It is an additional object of the present invention to provide a method and apparatus for covering a load on a trailer bed that does not require dragging the tarp across the load.

It is a further object of the present invention to provide a method and apparatus for improving the efficiency in terms of time and safety of tarping a load on a trailer bed.

It is also an object of the present invention to provide a relatively inexpensive method and apparatus for tarping a load on a trailer bed.

BEST MODE FOR CARRYING OUT THE INVENTION

Figure 1:
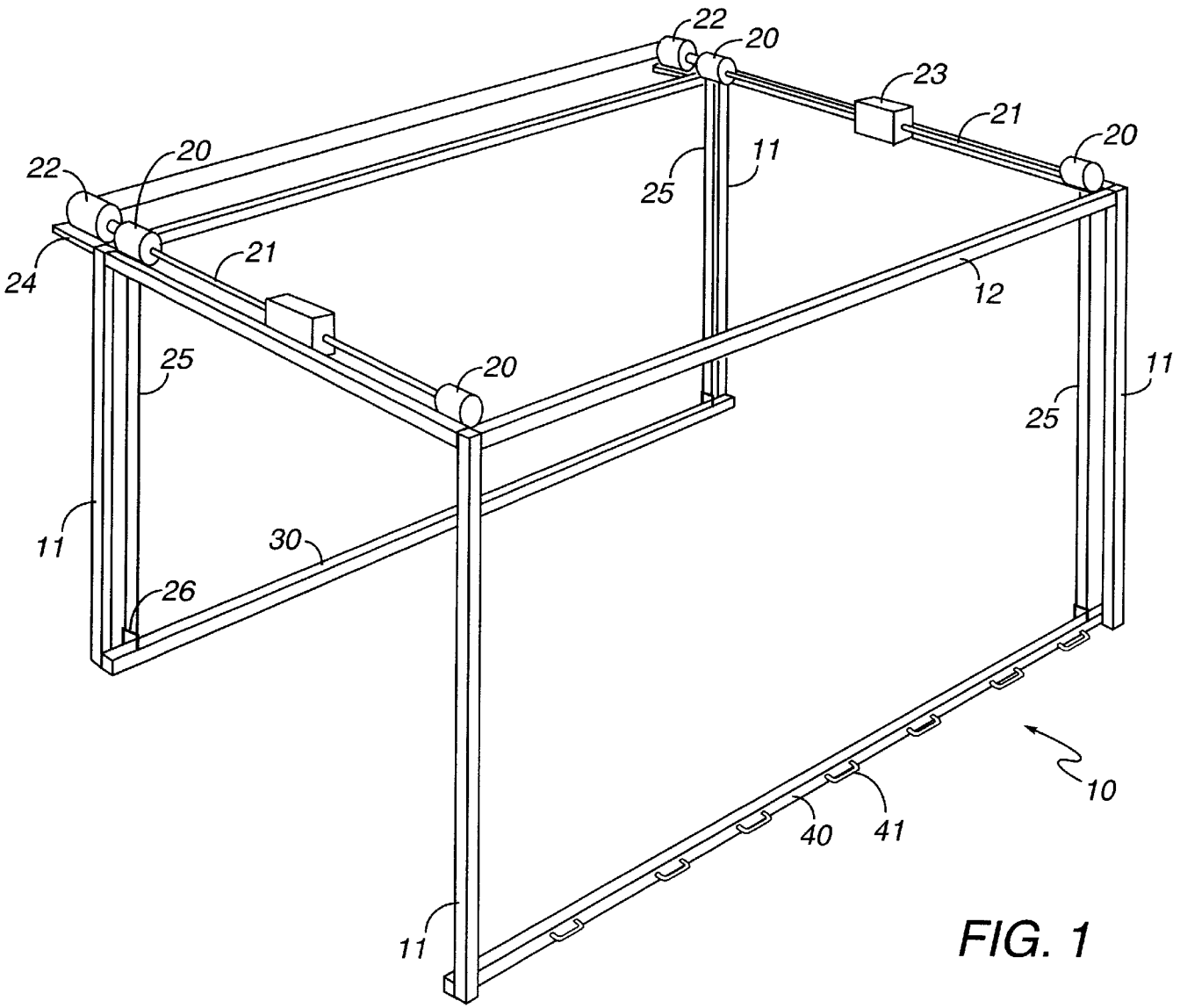
FIG. 1 depicts an overall aerial view of one fundamental unit of the truck tarping apparatus without the first set of truck straps or cover.
Figure 1A:
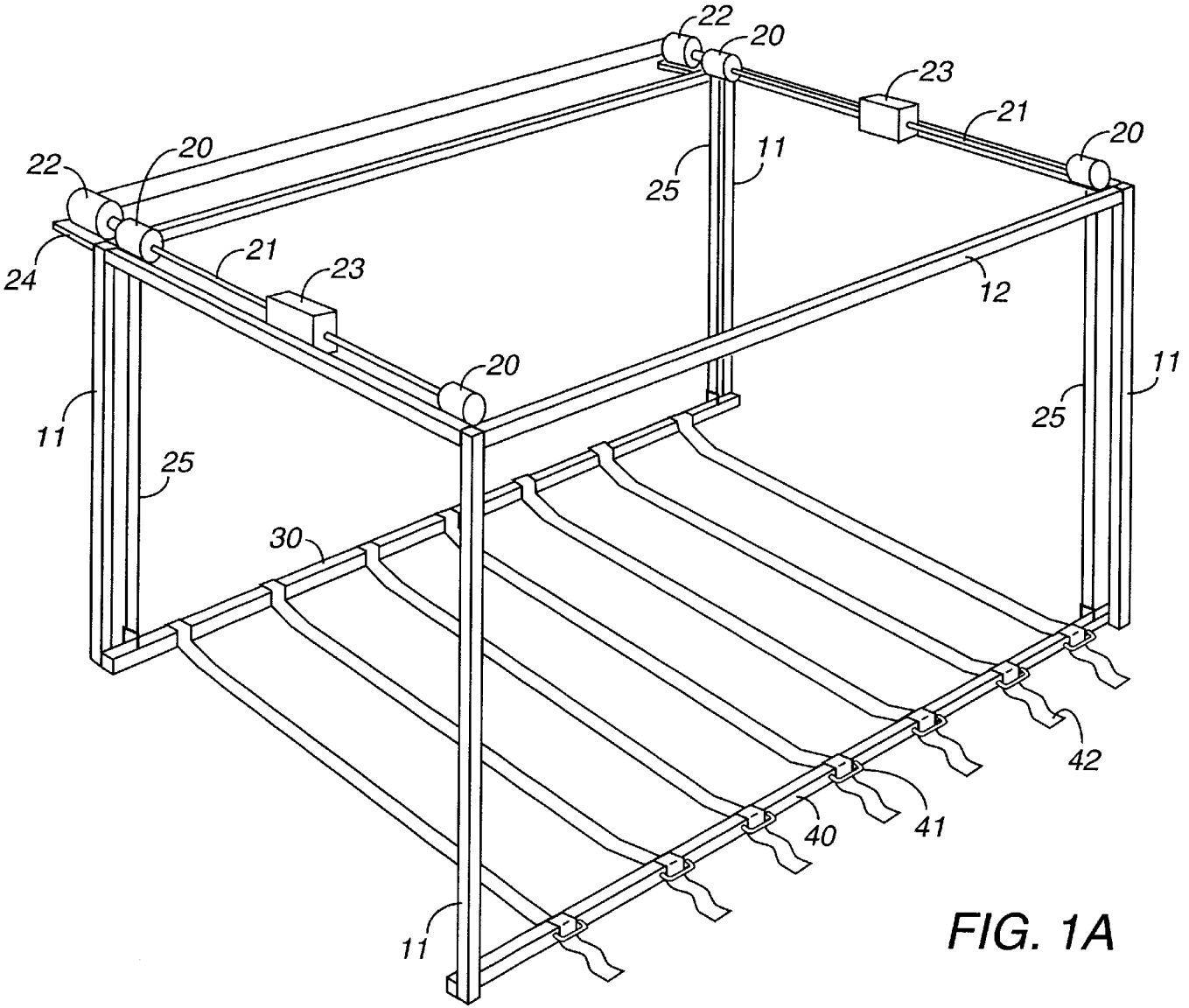
FIG. 1A depicts an overall aerial view of one fundamental unit of the truck tarping apparatus without the cover.

Referring now to the drawings in detail, for the ease of the reader, like reference numerals designate identical or corresponding parts throughout the views depicted in the drawings. With regard to FIG. 1, four vertical support members (11) arranged vertically are attached to a rectangular top frame (12) to form the framework for each fundamental unit (10) of the apparatus. The apparatus can be made of any strong and sturdy material. For the preferred embodiment, steel tubing is used for the construction of the tarping apparatus.

Fixedly secured to two corners of the top frame (12) on opposite corners of a long side of the rectangle are two gear motors (22). The gear motors (22) rotate a keyed shaft (21) that is fixedly secured on both ends to a spool (20). A coupling device (23) located in the middle of the short side of the rectangular top frame (12) stabilizes the keyed shaft (21). Fixedly secured to the spools (20) are the lifting truck straps (25) that extend downward from the spools (20) and are attached to the arms (30 and 40) of the apparatus through the use of the lifting u-hooks (26). While the preferred embodiment utilizes two motors, one skilled in the art could easily use one or a plurality of motors. In an embodiment with just one motor, the second motor would be replaced with a passive gear or U bracket, or like device. The lifting truck strap then would pass through the passive device, extend horizontally, parallel to the long side of the top frame, and would connect to the spool with the other lifting truck strap.

Figure 10:
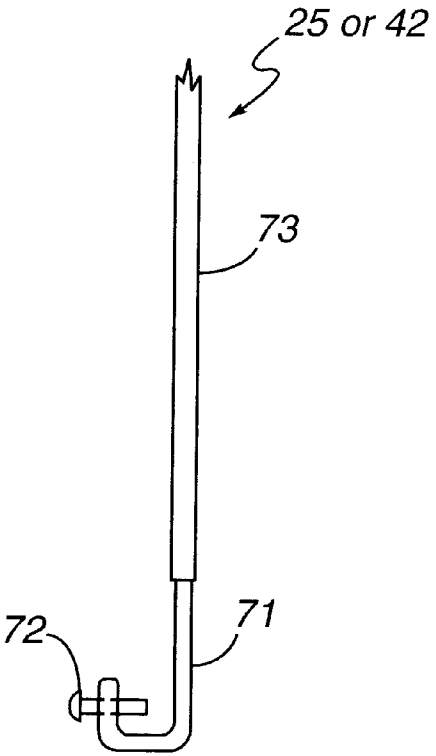
FIG. 10 depicts a side view of the end of a commercial truck strap such as the type used in the present invention.

The lifting truck straps (25) utilized by the present invention are commercially available truck straps. At one end of all commercially available truck straps is a metal attachment member (71) shaped like a fishhook as depicted in FIG. 10. Through one side of the attachment member (71) is a barrier member (72) that prevents the truck strap from rotating off the u-hook (26) accidentally. The attachment member (71) of the truck strap hooks the u-hooks (26) located on the arms (30 and 40) of the truck tarping apparatus. The arms of the apparatus (30 and 40) are lifted when the spools (20) are rotated and the lifting truck straps (25) wrap around the spools (20). Each of the spools (20) on the four corners of the top frame operates at the same speed so as to allow smooth and simultaneous lifting of the arms (30 and 40) of the apparatus.

Figure 8A:
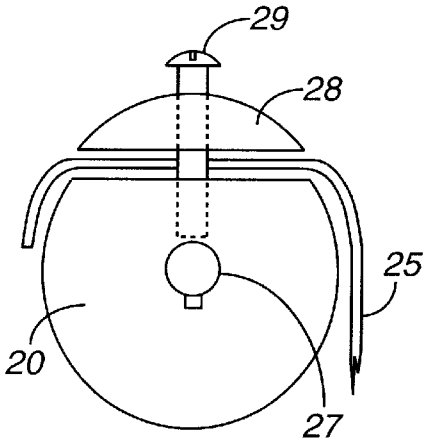
FIG. 8A depicts an exploded front prospective view of the spool assemblies.
Figure 8B:
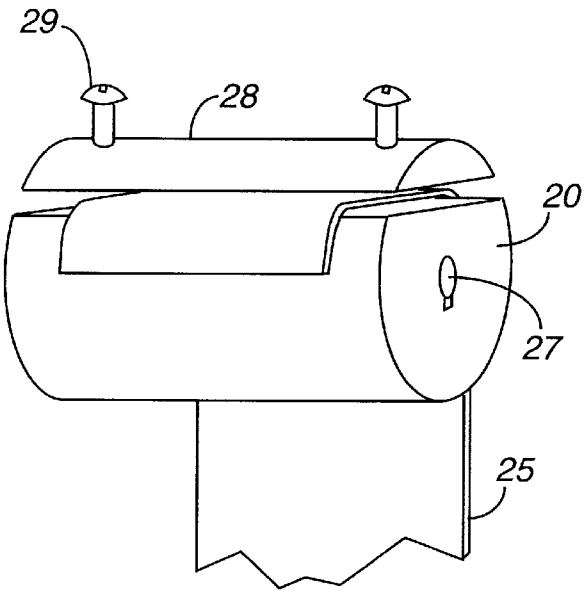
FIG. 8 depicts an exploded side view of the spool assemblies.

The spool assembly (20) is comprised of a spool (20) having one flat side and also having a keyed access hole (27) through which a keyed shaft (21) can lock so as to rotate the spool assembly (20) as depicted in FIG. 8. The end of the lifting truck strap (25) is laid over the flat side of the spool and secured by a strap attachment member (28) that is placed on top of the lifting truck strap. The strap attachment member (28) is fixedly secured to the spool through an attachment member that will secure the strap without tearing, piercing or puncturing the lifting truck strap. In the preferred embodiment, two screws (29) on opposite ends of the strap attachment member are screwed into the spool. As the spool rotates, the strap is wound around the spool assembly (20) and smoothly lifts the arms (30 and 40) of the apparatus. In another embodiment, the spool assembly can also have two additional circular protective members attached to the ends of the spool to insure that the strap does not move in a side to side fashion. The circular protective members also have a keyed access hole to allow the keyed shaft to engage the spool assembly.

Figure 5:
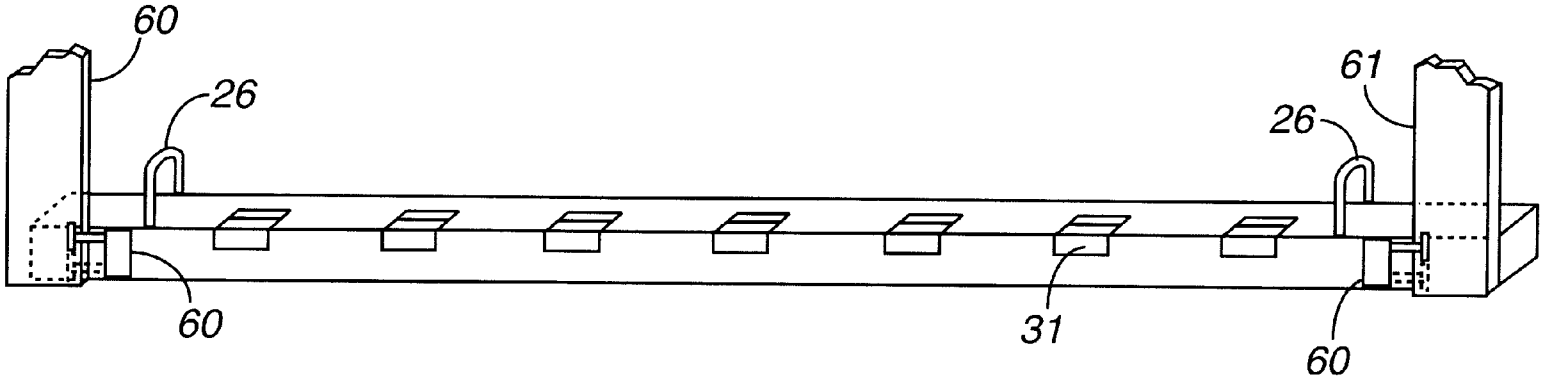
FIG. 5 depicts an exploded view of the first arm of the apparatus.
Figure 6:
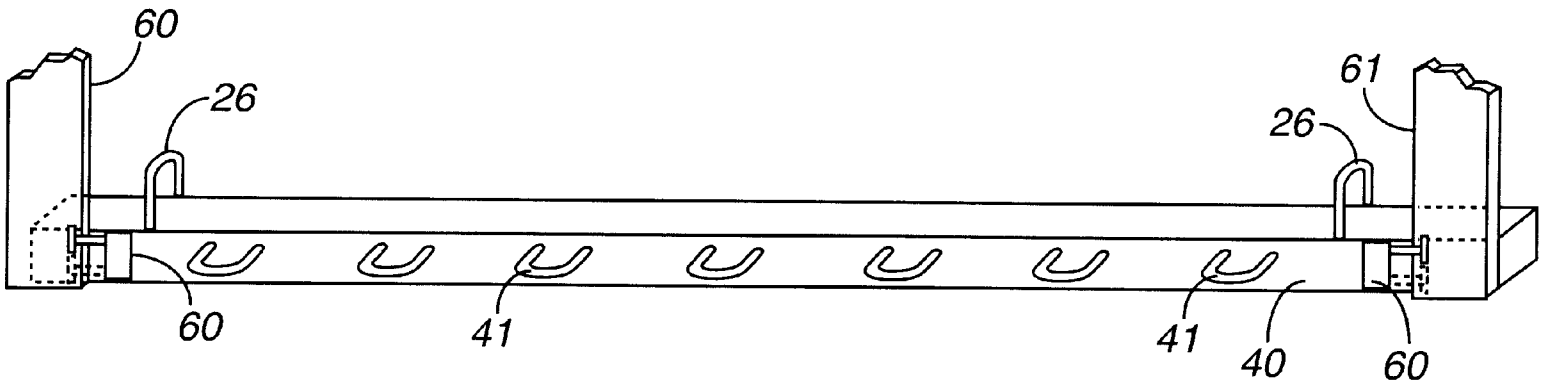
FIG. 6 depicts an exploded view of the second arm of the apparatus.

With reference to exploded views depicted in FIGS. 5 and 6, the arms (30 and 40) of the apparatus are constructed of any strong and sturdy material. For the preferred embodiment, steel tubing is used for the construction of the truck tarping apparatus because items can be easily attached to the steel tubing. A plurality of quick release hangers (31), lifting u-hooks (26), strap u-hooks (41) and roller assemblies (60) are fixedly secured to the first (30) and second (40) arms of the apparatus. The lifting u-hooks (26) are located at opposite ends of both of the arms (30 and 40) positioned so that the lifting truck straps (25) can extend directly downward from the spools (20) to engage the lifting u-hooks (26). In the preferred embodiment, the lifting u-hooks (26) are located not farther than one (1) foot from each end of the first and second arms of the apparatus. In the preferred embodiment, two gear motors assemblies are located in series to allow the entire length of a truck trailer bed to be covered simultaneously. In this embodiment, the gear motors will all be attached to the same control unit (not shown) with the ability to raise and lower each set of arms individually or simultaneously.

Figure 9A:
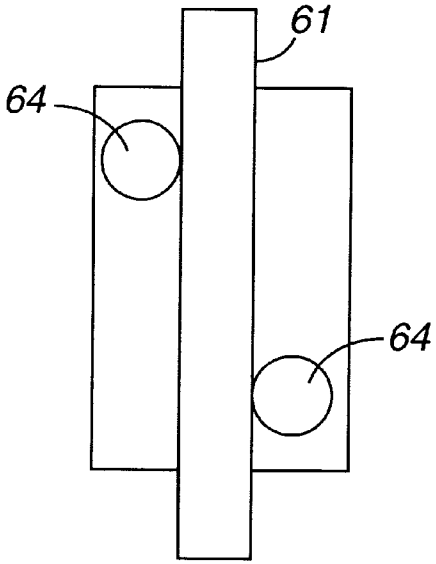
FIG. 9A depicts an exploded view of the roller assemblies from the perspective of looking down the plate axis.
Figure 9:
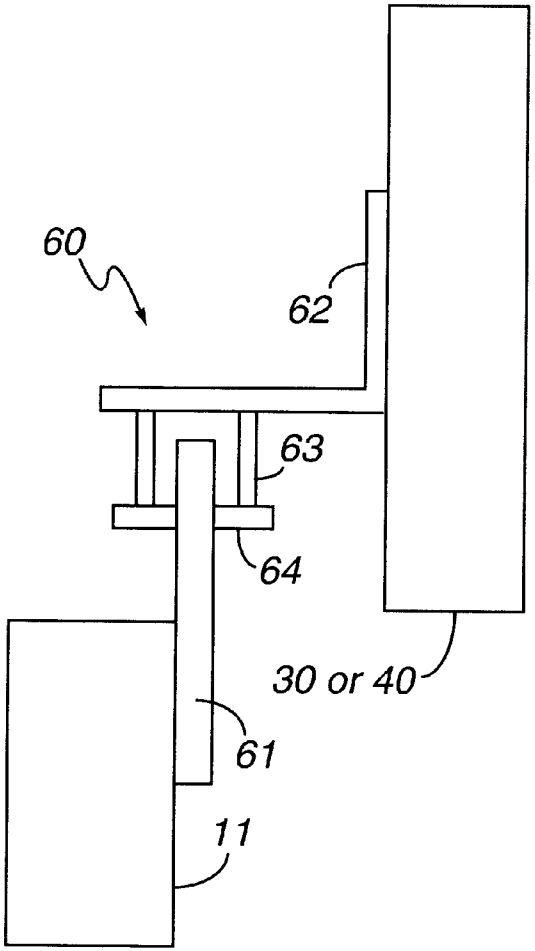
FIG. 9 depicts an exploded top view of the roller assemblies.

With reference to FIGS. 9 and 9A, roller assemblies (60) are located at each end of the first (30) and second (40) arms of the apparatus. In the preferred embodiment, the roller assemblies utilize both the arms (30 and 40) and the vertical support members (11) of the apparatus. Each roller assembly has an angle (62) that further comprises a vertical support attachment member and a roller attachment member with an outside face. The vertical support attachment member and the roller attachment member form a ninety-degree angle with respect to each other. The vertical support member attachment member is fixedly secured to an end of one of the arms (30 or 40) of the truck tarp loading apparatus. In the preferred embodiment, a pair of extenders (63) are fixedly secured to the roller attachment member on the outside face such that the extenders are diagonally opposite one another as depicted in FIG. 9. Lastly, rollers (64) are fixedly secured to the extenders so that the rollers engage and roll against a plate (61) that is fixedly secured to the vertical support member (11) such that the plate extends therefrom and runs contiguously along the height of the vertical support member (11). It is obvious to one skilled in the art that any number of roller-extender combinations can be used. In addition, the roller assembly described herein can be modified to directly engage the vertical support member of the apparatus rather than a plate attached to the vertical support member.

Figure 7:
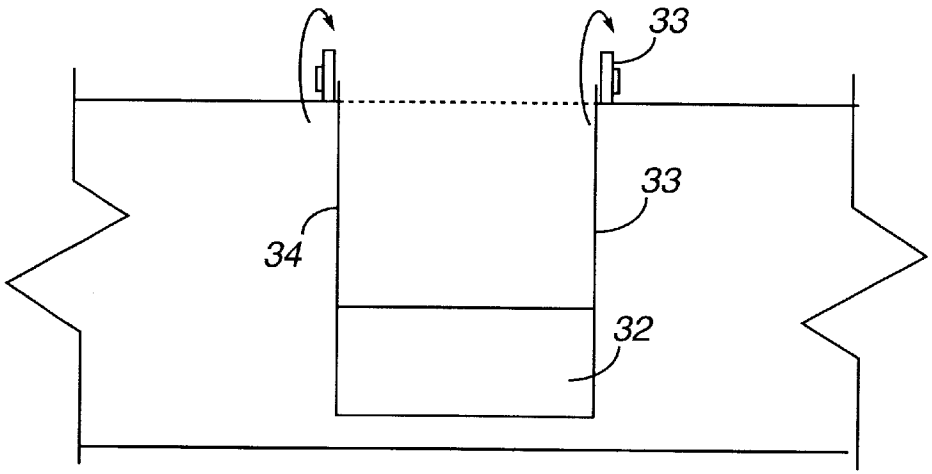
FIG. 7 depicts an exploded top view of the quick release hangers.
Figure 7A:
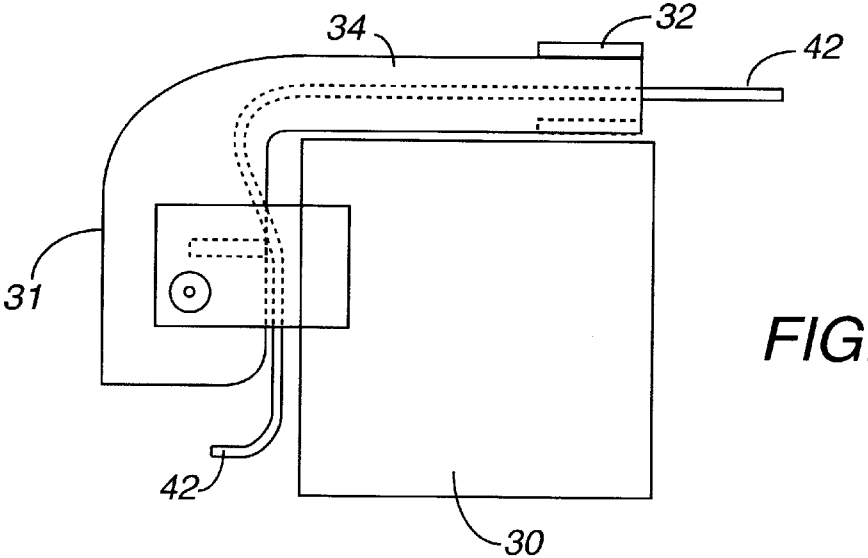
FIG. 7A depicts an exploded side view of the quick release hangers.

As depicted in FIG. 5, the first arm (30) of each fundamental unit of the apparatus has a plurality of quick release hangers (31) attached to one face of the first arm. Typically, the number of quick release hangers needed to adequately support the tarp with the set of truck straps (42) is in the range of five to twelve hangers evenly spaced along the first arm. Most preferably, the number of quick release hangers is seven. The hangers (31) fold over to a second face of the first arm as depicted in FIGS. 7 and 7A. Each quick release hanger (31) comprises two sides (34). Each side (34) further comprises a horizontal member and a rounded L-shaped member integral with the horizontal member. In a more preferred embodiment, one end of the L-shaped member has an additional barrier fixedly secured to the member to limit the rotation of the quick release hanger with respect to the first arm (30) of the truck tarping apparatus. The sides (34) are fixedly secured to a face of the first arm with an attachment member (33) and operatively arranged so as to permit movement about the axis of the attachment member (33) with respect to the first arm (30) of the truck tarping apparatus. The quick release also includes a plurality of guiding members (32) that are integral with the sides. As contemplated by the inventor, the guiding members (32) can be a set of plates through which one of the truck straps is guided so that the truck strap is secured. In another embodiment, the guiding members (32) are a set of bars wherein the strap is threaded over one bar and under another and threaded against the arm. Any other sort of members that would allow the truck straps (42) to be guided to its optimal position can be used with the present invention. When downward pressure is applied to the truck strap, usually when the tarp and/or plastic are placed on the truck straps, the truck straps are held in place without any piercing or locking which can cause damage to the straps. When the cover and underlying straps are resting on the load on bed, upward pressure is applied by the load onto the straps. This upward pressure will act to loosen or pull the straps (42) from the strap u-hooks (41). The straps will fall from underneath the cover. The truck straps are threaded through the guiding members as depicted in FIG. 7A.

The second arm (40) of each fundamental unit of the apparatus has a plurality of u-hooks (41) located along one face of the second arm. These u-hooks (41) are utilized to secure the metal attachment member (71) of the truck straps to the second arm (40) of the apparatus. The truck straps (42) utilized by the present invention are commercially available truck straps. At one end of all commercially available truck straps is a metal attachment member (71) shaped like a fishhook as depicted in FIG. 10. Through one side of the attachment member (71) is a barrier member (72) that prevents the truck strap from rotating off the strap u-hook (41) accidentally.

As described above, the truck tarp loading apparatus is a stationary object. The trucks must drive under the apparatus in order for the trailer bed to be covered with the tarp. As another embodiment, the inventor contemplates designing an overhead crane system and support system that will allow the truck tarping apparatus to be lifted from trailer bed to trailer bed, thus allowing the trucks to remain stationary.

Figure 2:
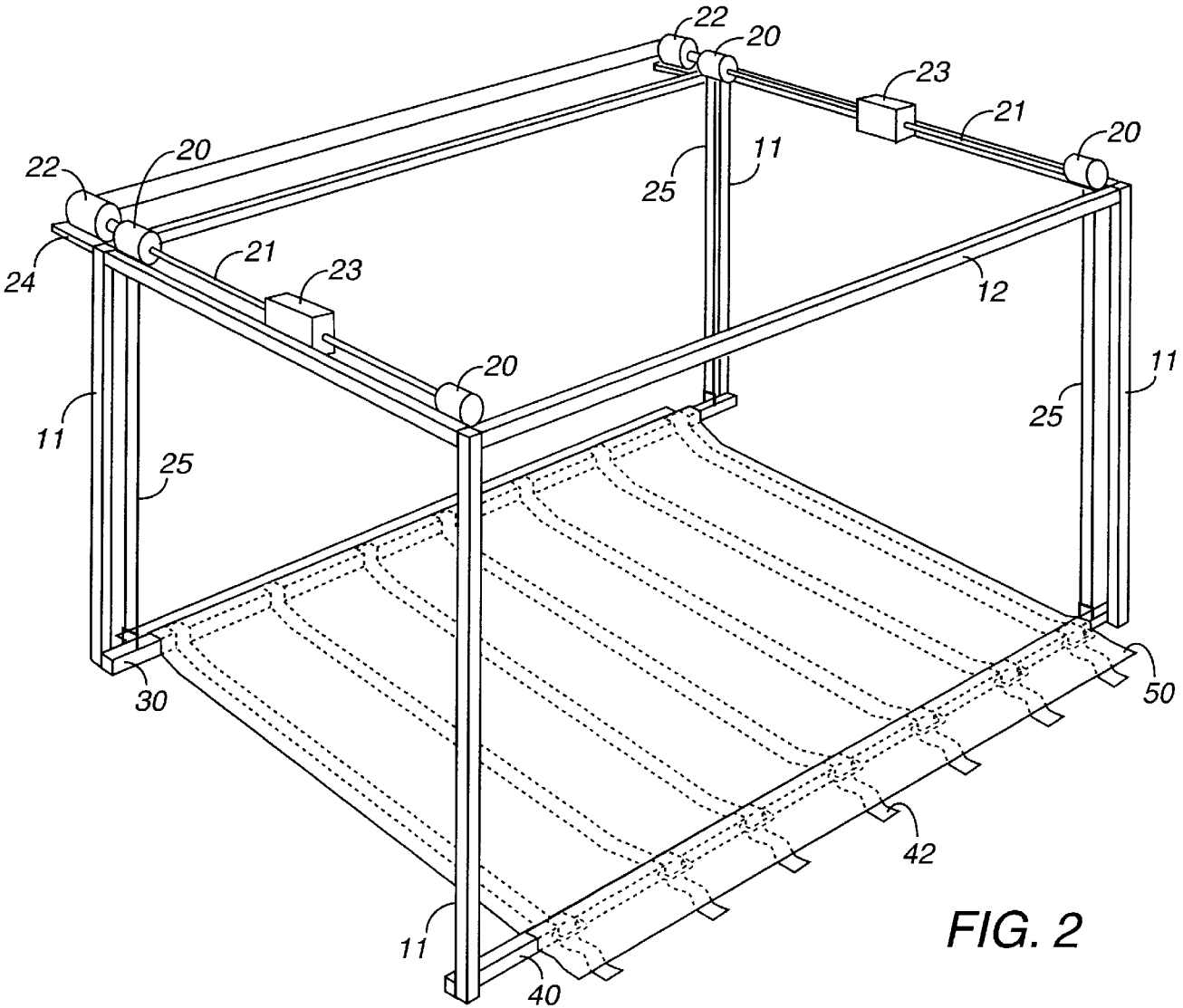
FIG. 2 depicts an overall aerial view of one fundamental unit of the truck tarping apparatus with a tarp lying over the truck straps.
Figure 3:
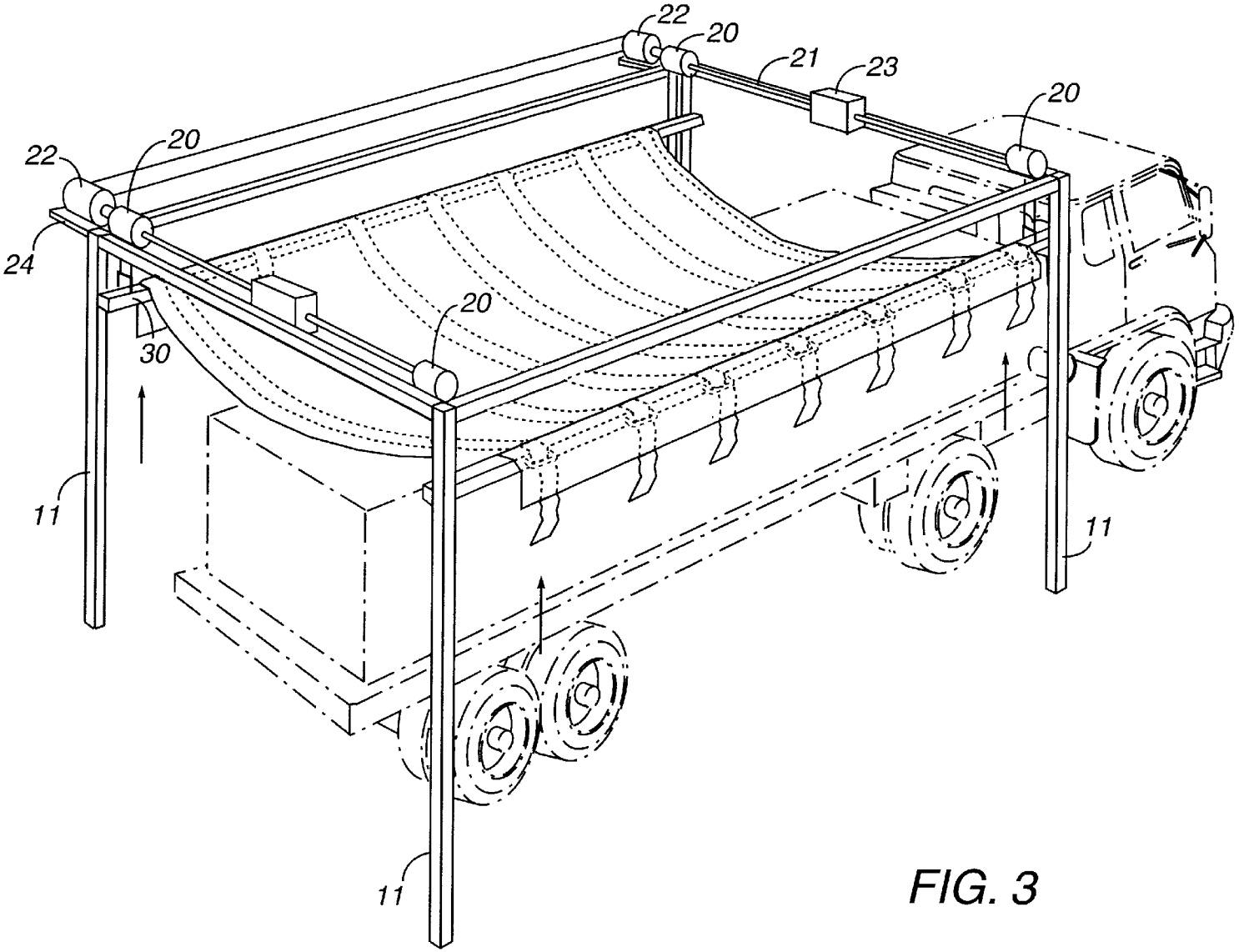
FIG. 3 depicts an overall aerial view of one fundamental unit of the truck tarping apparatus with the arms of the apparatus raised with a tarp loaded.
Figure 4:
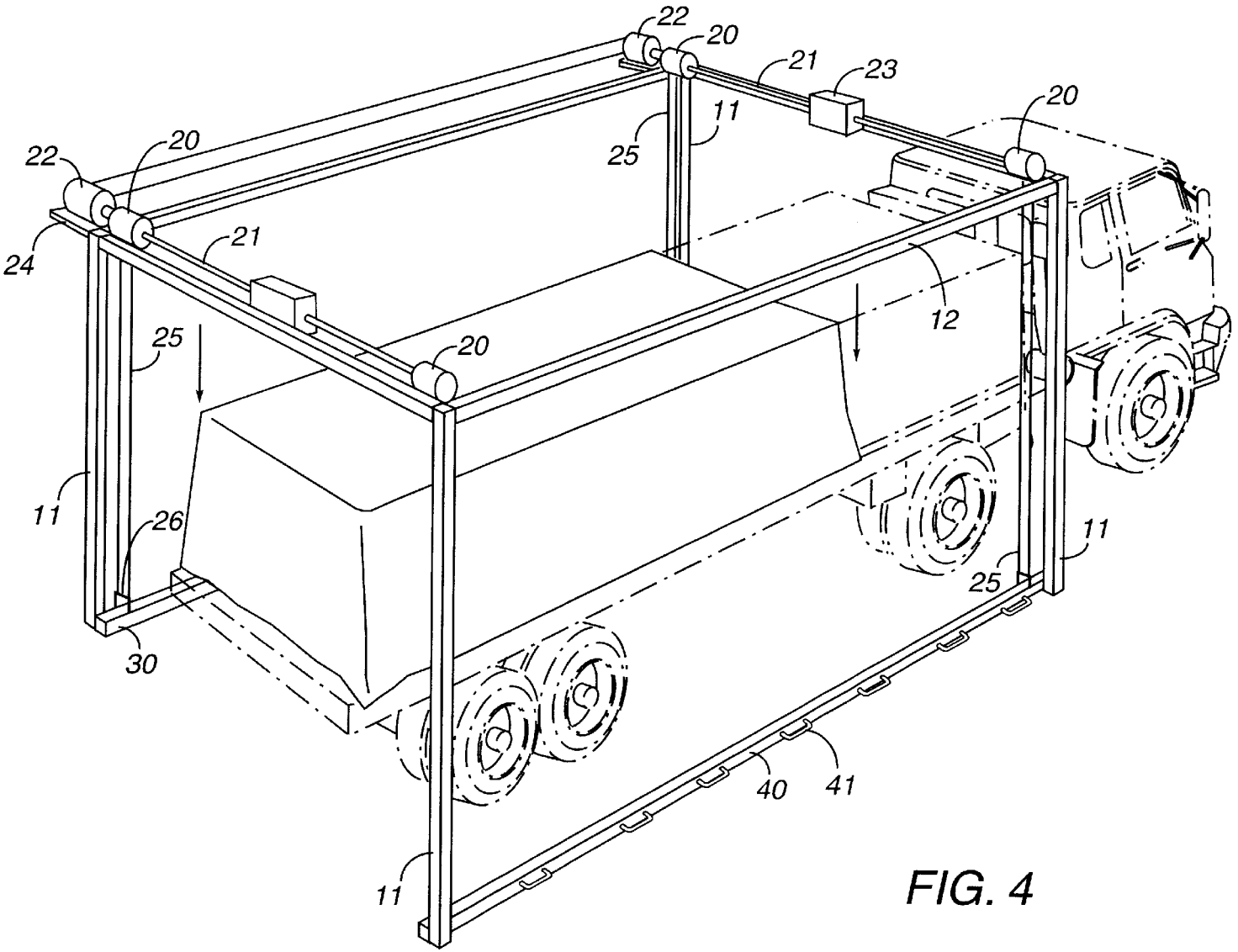
FIG. 4 depicts an overall aerial view of one fundamental unit of the truck tarping apparatus with the arms of the apparatus lowered and the tarp covering the load on the bed of the truck.

The method of using this apparatus is simple and requires only one operator, although for efficiency's sake, more than one operator may be used to speed up the process of unfolding the tarp over the truck straps. First, the operator insures that the arms are lowered to the ground. The truck straps are then attached to the second arm of the apparatus and carried over to the first arm of the apparatus and attached to the quick release hanger by lifting the hanger and threading the truck strap through the guiding members of each of the quick release hangers so that the truck strap is resting against the first arm of the apparatus. The plastic (50) is then placed over the truck straps, if such a plastic covering is desired. The tarp is then unrolled over the truck straps so that the tarp lays flat and just overlaps the arms of the apparatus as depicted in FIG. 2. In the preferred embodiment, the operator then pushes the control button to raise both arms of the apparatus simultaneously. The loaded trailer bed is then driven underneath the truck tarping apparatus as depicted in FIG. 3. In the preferred embodiment the operator then pushes the control button to lower the arms of the apparatus so that the trailer bed may be covered as depicted in FIG. 4 and the tarp secured through manual means. In another embodiment, each set of arms may be raised individually. The operator then pushes the control button to lower the arms individually allowing either the front or back of the load to be covered prior to the opposite end being covered. The load on the trailer bed is now covered and fully protected from the elements. After covering the load, the straps are removed as described supra.

As another embodiment of the method of using the truck tarping apparatus, if the truck tarping apparatus is modified to allow the trucks to remain stationary, the operator will then unfold the tarp onto the apparatus and lift the arms of the apparatus so that the tarp is in a raised position. Then, the operator will control the lifting and positioning of the entire apparatus over a stationary loaded truck trailer bed. All other steps of the method of tarping the truck load will remain the same.

Another embodiment envisioned by the inventor that would allow the object to be covered to remain stationary would involve the placement of wheels casters, rollers, or other similar moving devices to the bottom of each vertical support member. This would allow the entire apparatus to be moved over the object to be covered rather than moving the object beneath the raised apparatus.

Although truck straps are described as the best embodiment for both the lifting of the arms and for the tarp material, it is clear to those skilled in the art that any strong and flexible material could be used. Examples of these would be rope-type products, cables made from any suitable material, chains made from suitable materials, straps made of rubber, plastic or the like, as well as any material that would possess the strength and flexibility needed in keeping with the spirit of the invention.

Although all references are made to covering the load carried on a truck, it is obvious to one skilled in the art that the invention could be utilized to cover any large object or container. Obvious variations would apply to covering railroad cars, large garbage containers, large piles of sand or gravel, or any large object or container that could benefit from protective coverings.

Although all references are made to covering the load, it is obvious that the reverse process of uncovering the load could be accomplished by the invention. This process would be achieved by simply taking each step mentioned above in reverse order. This would prevent damage to the load or covering that could occur while removing the covering from the load.

Although the invention is described by reference to a specific preferred embodiment, it is obvious to one skilled in the art that variations can be made without departing from the spirit of the invention as claimed.

What is claimed is:

1. An apparatus for covering large objects comprising:

a fundamental unit comprising vertical support members attached to a top frame;

arms attached to a plurality of rollers, said rollers being aligned to move against said vertical support members;

a plurality of hanger members attached to said arms;

a first plurality of straps secured to said hanger members;

a lifting device operatively engaging said arms to move the arms in a vertical fashion while keeping the arms substantially horizontal; and, a cover placed on top of and overlapping said arms.

2. The apparatus for covering large objects according to claim 1 wherein the lifting device comprises:

a plurality of lifting hooks attached to said arms;

at least one motor mounted on said top frame, operatively engaging a shaft;

a plurality of spools mounted to said shaft;

said spools each having a strap attachment member; and, a second plurality of straps, having two opposite ends, wherein each strap is attached to one of said strap attachment members at the first end and engaging the lifting hooks at the second end.

3. The apparatus for covering large objects according to claim 2 wherein:

said second end of each strap of said second plurality of straps is connected to a metal attachment member;

said metal attachment member possesses a barrier member;

wherein said barrier member engages said lifting hooks preventing said metal attachment member from accidentally disconnecting from said lifting hooks.

4. The apparatus for covering large objects according to claim 2, wherein the strap attachment member comprises two sections;

each section having a parallel face;

said two sections being connected along said parallel faces.

5. The apparatus of claim 2 wherein moving devices are attached to said vertical support members.

6. The apparatus of claim 5 wherein said moving devices are wheels.

7. The apparatus of claim 5 wherein said moving devices are casters.

8. The apparatus for covering large objects according to claim 1 wherein said hanger members for said arms comprise quick release hangers.

9. The apparatus for covering large objects according to claim 8 in which each said quick release hanger comprises two; said sides further comprise a horizontal member and a rounded L-shaped member integral with said horizontal member; and said sides are fixedly secured to said arm one with at least one attachment plate.

10. The apparatus for covering large objects according to claim 1 wherein said hanger members for said arms comprise U-shaped hooks.

11. The apparatus for covering large objects according to claim 1 wherein said shaft possesses a key; each said spool contains a keyed shaft access hole corresponding to the key on the shaft; each said shaft is inserted and locked into place in the keyed shaft access hole.

12. An apparatus for covering large objects according to claim 1 wherein:

said rollers are aligned to rotate against said vertical support members.

13. An apparatus for covering large objects according to claim 1 wherein:

said rollers are aligned to slide against said vertical support members.

14. The apparatus for covering large objects according to claim 1, wherein said cover is a canvas material.

15. The apparatus for covering large objects according to claim 1, wherein said cover is a plastic material.

16. The apparatus of claim 1 wherein moving devices are attached to said vertical support members.

17. The apparatus of claim 16 wherein said moving devices are wheels.

18. The apparatus of claim 16 wherein said moving devices are casters.

19. A method for covering large containers comprising:

securing truck straps to hanger members attached to movable arms;

laying a covering material over said truck straps;

lifting said arms and thereby lifting said covering material;

placing a large container under said lifted covering material;

lowering said covering over the container; and securing said covering to said container.

20. The method for covering large containers according to claim 19 wherein said large container is a trailer bed.

* * * * *